US005707230A

United States Patent [19]

Kiss

[11] Patent Number: 5,707,230

[45] Date of Patent: Jan. 13, 1998

[54] COOLABLE LINING FOR A HIGH-TEMPERATURE GASIFICATION REACTOR

[75] Inventor: Günter H. Kiss, Minusio, Switzerland

[73] Assignee: Thermoselect A.G., Liechtenstein, Germany

[21] Appl. No.: 449,753

[22] Filed: May 25, 1995

[30] Foreign Application Priority Data

Jun. 10, 1994 [DE] Germany ..... 44 20 450.7

[51] Int. Cl.[6] ..... F27D 1/12

[52] U.S. Cl. ..... 432/238; 110/336

[58] Field of Search ..... 110/235, 336; 432/238, 264

[56] References Cited

FOREIGN PATENT DOCUMENTS 1646741 6/1973 Germany .

1934486 10/1976 Germany .

2751912 6/1978 Germany .

3538044 3/1989 Germany .

*Primary Examiner*—Noah P. Kamen

*Attorney, Agent, or Firm*—Howard & Howard

[57] ABSTRACT

A coolable lining for a high-temperature gasification reactor, especially in the zone of a replaceable lower furnace, in which the refractory brickwork receives the melting liquid occurring in the melting operation during the gasification of household, industrial and special wastes. The refractory material, consisting of oxides of non-noble meals, is pierced at defined intervals by straight channels, into which it is possible to insert cooling elements that can be installed and removed from the outside.

9 Claims, 3 Drawing Sheets

COOLABLE LINING FOR A HIGH-TEMPERATURE GASIFICATION REACTOR

TECHNICAL FIELD

The invention concerns cooled linings for high-temperature furnaces, and more particularly to such linings positioned in the zone of a replaceable lower furnace.

BACKGROUND ART

Temperatures of more than 2,000° C. occur in the melting zone during the high-temperature gasification of wastes with oxygen. Neither the composition nor the viscosity of the cinders occurring during waste gasification can be determined beforehand because of the heterogeneity of the wastes used.

The amphoteric character of the meltings and the corrosive components contained in the synthesis gas, such as hydrogen chloride, hydrogen fluoride and hydrogen sulfide, lead to an additional degradation of the lining material used. In addition to that, the reducing atmosphere prevailing inside the high-temperature reactor prevents the use of refractory material with heavy-metal.

Oxide components, for example, $Cr_2O_3$, because these are reduced to metallic sponge already at temperatures in the 1000° C. range in the presence of reducing media, such as hydrogen and carbon monoxide. This metallic sponge resists neither the corrosive components, for example, hydrogen chloride, nor the high prevailing temperatures inside the gasification reactor nor the liquid melted cinders.

All known refractory materials are exposed to high thermal, chemical and mechanical wear, which leads to a correspondingly short working life and long periods of repair time, with all the economic and technical disadvantages. The melting furnace must be switched off, cooled, relined and reheated, which usually leads to an interruption of production lasting several weeks. The fitting out of the lower furnace of a high-temperature reactor as a rapid-replacement installation is known (DE-PS 4,211,514).

Omitting the brickwork over this melting zone and equipping it with cooling tubes is a generally known method for extending the service time of melting furnaces. Steel or copper tubing is normally used for this purpose.

If the waste to be gasifier contains iron components and these come into contact with the oxygen used for gasification, exothermal reactions with a corresponding increase in temperature are triggered, which can damage the steel tubes. If copper tubes are used, which have better heat-conductive capacity than steel tubes, higher corrosion loading must be taken into consideration, which likewise has a negative effect upon operating time.

On the other hand, if a cooled brick lining is used, the meltings freeze on the lining, the cinders forming a so-called self-coating. The cooling system normally consists of shaped tube segments.

Cooling tube systems which are permanently installed in parts of the brickwork of metal-smelting furnaces are known (DE 1,934,486). The known systems consist of a single tube whose interior space is subdivided into two upper and lower lengthwise chambers, which are interconnected. The coolant ordinarily employed is water.

Also known is the installation of cooling devices for blast furnaces in the brickwork of the exterior armor of the furnace in such a way that they can be replaced. Special openings are provided in the exterior armor for this purpose, which permit installation and removal of the cooling elements detachably anchored in the furnace armor (DE-OS 2,751,912).

The use of aluminum oxytrinitride, represented by the chemical formula $mAl_2O_3$—nAlN and produced by heating a mixture of microfine aluminum oxide with powdered aluminum nitride to the point of sintering, is also known as a refractory material for the brickwork of high-temperature surfaces. The aluminum oxytrinitride thus obtained exhibits excellent resistance to flame and heat and possesses excellent corrosion resistance in molten metal. It is therefore assumed to find extensive use as a refractory material, especially for use in a reducing atmosphere (DE 3,538,044).

Other known refractory materials are mixtures of one or more of the substances $SiO_2$, $ZrO_2$, $Al_2O_3$, MgO, sillimanite, mullite or zirconium.

Because the welded construction of cooling-tube systems and the refractory mass have different rams of heat expansion, stresses can develop in the cooling segments and cracks result, which at least significantly reduces the cooling capacity. If leakage occurs, this cooling segment has to be shut down, because immediate destruction of the furnace lower part can result.

The described relationships hold true of course for the entire interior space of the high-temperature gasification reactor; but they are naturally more intense in the lower furnace containing the reaction and melting zone.

SUMMARY OF INVENTION AND ADVANTAGES

The goal of the present invention is therefore to make available a coolable lining, especially for the region of the lower furnace of a high-temperature gasification reactor for the gasification of wastes, with which the working life of conventional lower furnaces can be significantly extended, down time for the replacement of cooling elements being entirely eliminated.

This goal is achieved by a coolable lining for a high-temperature gasification reactor, especially in the zone of a replaceable lower furnace, where the refractory material-brickwork receives the liquid melted material occurring during the gasification of municipal solid waste, and characterized by the refractory material of the lining consisting essentially of oxides of non-noble metals, such as $Al_2$, $O_3$, MgO or mixtures of the same and that there are channels in the refractory material at defined intervals in which cooling elements can be installed and removed.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
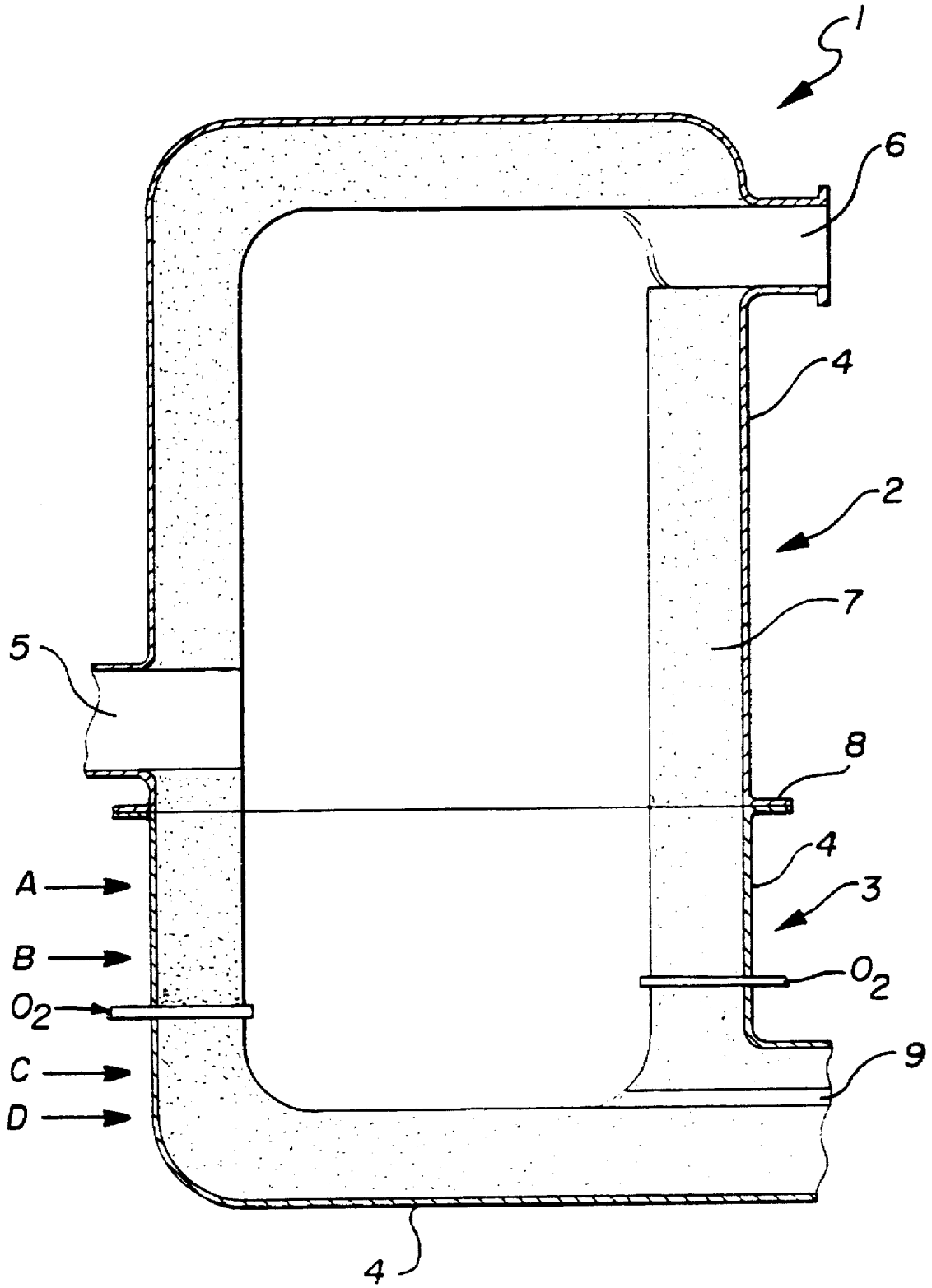
FIG. 1 is a cross-sectional side elevational view of a typical high-temperature gasification reactor having a replaceable lower furnace.

Referring to the accompanying figures, wherein like reference numerals represent like or corresponding parts throughout the several views, FIG. 1 shows a high-temperature gasification reactor 1 according to the subject invention having an upper part 2 and a replaceable lower furnace 3. The upper part 2 includes a reactor furnace 4 having a charging opening 5. A gas outlet 6 discharges synthesis gas from the reactor furnace 4. The reactor 1 is generally fabricated of a refractory brickwork 7, with the upper part 2 and replaceable lower part 3 being joined together along a separating line and mounting flange 8. Liquefied residual materials egress from the lower furnace 3 via a melt outlet 9. The arrows identified by the reference characters A, B, C and D indicate the planes in which the polygons of cooling elements are arranged. Oxygen lances are indicated by the symbol $O_2$.

Figure 2:
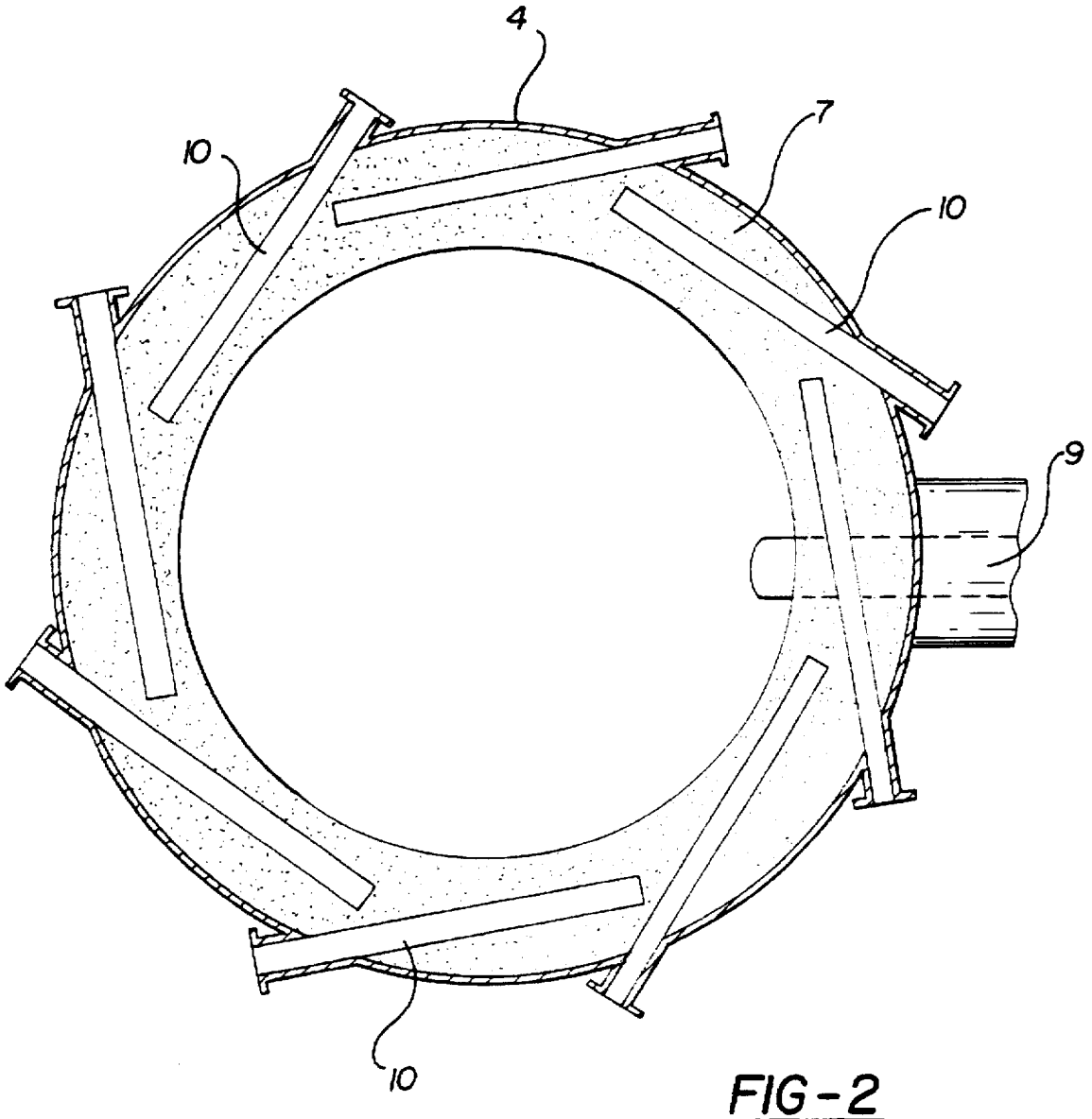
FIG. 2 is a cross-sectional view taken horizontally through the lower furnace.

FIG. 2 shows a cross-sectional view taken horizontally through the lower furnace at any one of the planes A, B, or C in FIG. 1. The polygon arrangement of the cooling elements, as described in greater detail below, is demonstrated by the mounting channels 10.

Figure 3:
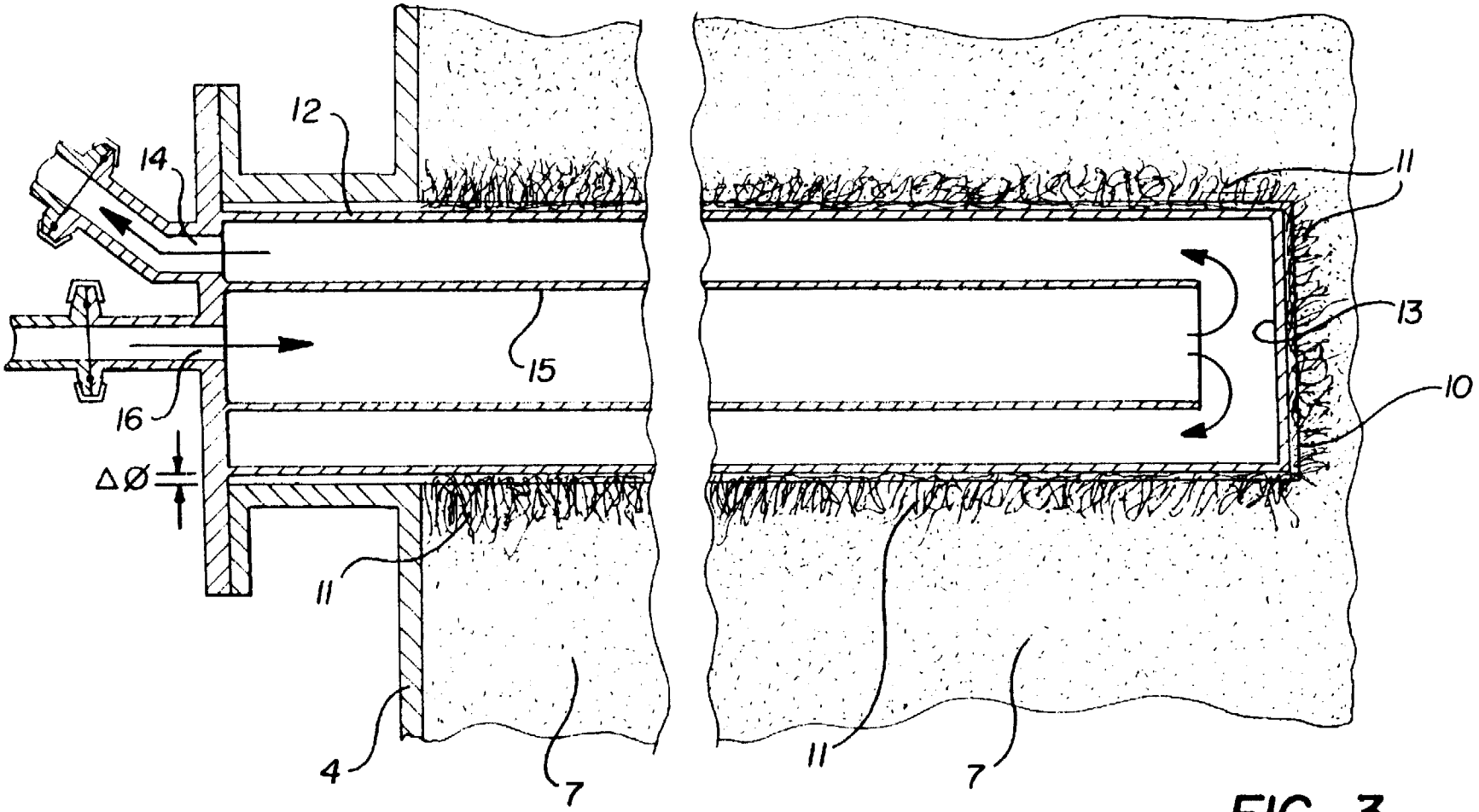
FIG. 3 is an enlarged view of a cooling element disposed in a channel in the refractory brickwork and surrounded by resilient heat-transfer medium.

FIG. 3 shows a single cooling element disposed in a channel 10 in the refractory brickwork 7 and surrounded by resilient heat-transfer medium 11. The cooling element is composed of an outer tube 12 and an inner tube 15. Outlet and inlet connecting elements 14, 16 are provided for the coolant. Sensor 17 is provided to monitor temperature and pressure in the cooling elements.

If the refractory material consists of oxides of non-noble metals with high affinity for oxygen, they also cannot be reduced to metallic sponge at high temperature by hydrogen and carbon monoxide. If the cooling tubes are furthermore arranged in the straight channels at definite intervals, so that they can be inserted, installed and removed from the outside, a replacement of all cooling elements or of each individual cooling element is possible in the simplest manner, without the need to shut down the furnace.

The combination of special refractory materials, in themselves not sufficiently heat-resistant, with a low-maintenance cooling system of the invented design and arrangement leads to a significantly longer service life for the entire high-temperature reactor, a replacement of the cooling system when the equipment is hot without removal of the lower furnace being possible.

If a mixture of $Al_2O_3$ and MgO is utilized as the refractory material of the brickwork, special advantages result:

Oxides of aluminum and magnesium are stable with regard to reducing atmospheres and also resistant to corrosive components, for example, hydrochloric acid. Mixtures of $Al_2O_3$ and MgO, known as magnesium-aluminum spinel, have a melting point in excess of 2,100° C. If such a refractory lining is cooled, it will be adequate for the thermal and chemical conditions which can occur during the high-temperature gasification of wastes.

Favorable conditions for the servicing and replacement of cooling elements result, if the cooling elements consist of an outer tube with a closed end and an inner tube arranged concentrically inside it for introduction of the cooling medium, the structural parts for introduction and removal of the coolant being arranged respectively on the same side, namely that side of the cooling element leading to the outside. All structural components are with this arrangement freely accessible, and each cooling element can be replaced when the furnace is hot, with no break in operation.

For replacement of the double-tube cooling element it is advantageous for the diameter of the cooling channels to be slightly larger than the diameter of the cooling elements. This avoids heat stresses resulting from different expansion coefficients of refractory brickwork, on the one hand, and cooling element, on the other. A good transfer of heat between the cooling element and brickwork is obtained, if the expansion space resulting from the difference in diameters is filled with a mechanically resilient heat-transfer medium. Suitable for this purpose are the heat-transfer pastes commonly utilized in other engineering fields. It is particularly advantageous, if stranded metal, such as wire felted in the manner of steel wool or metal chips, is used to improve heat transfer, for example, copper wire, which can be embedded in the refractory material on the side of the brickwork. A further advantage results, if felted metal wires are integrated directly into the refractory material around the cooling channels, that is to say, incorporated into the lining when the lining is being installed.

The cooling element can surround the lower furnace—in the manner of a polygon—and thus provide all-around cooling. According to local conditions, the resulting geometrical shape can be any polygonal arrangement ranging from the square to a figure with any desired number of sides. For reasons having to do with construction, a square, but also a six-sided arrangement may be expedient. Several such cooling polygons, arranged one above the other, form a cooling jacket enclosing the entire working zone of the lower-furnace brickwork.

Making the receiving channels in the brickwork straight through provides the advantage of better access to the cooling channels. In this case, a height offset within a polygon is necessary. If the height offset is not desired in the effort to obtain a larger cooling-surface density within the refractory brickwork, blind holes of equal height can be provided within a polygonal arrangement as cooling channels, perhaps also in the form of straight-through bores, provided on one end with removable plugs.

It is exclusively corrosion and not the effect of heat which determines the life span of the cooling tube. Preventive replacement of the cooling tubes when the plant is in operation avoids down time. The use of cooling tubes which do not corrode can significantly extend working life. The choice of the material will depend upon economic considerations.

The wearing of the cooling tube can be continuously monitored by ongoing measurement of the flow, pressure difference and temperature, permitting timely replacement of the cooling tube before it becomes defective and results in irreparable damage to the lower furnace due to a loss of cooling action.

For this purpose, each cooling element can be equipped with its own sensors for monitoring temperature conditions as well as to check for any leakage.

What is claimed is:

1. A coolable lining for the lower replaceable half of a high-temperature gasification reactor which receives liquid metal material occurring during the gasification of municipal solid waste, the lining comprising: a refractory material brickwork consisting essentially of oxides of non-noble metals and formed about a generally vertical central axis, characterized by a plurality of channels spaced radially of the central axis in the refractory brickwork at defined intervals, a removable cooling element disposed in each of the channels, the channels and associated cooling elements arranged within the refractory brickwork in the shape of a polygon about the central axis.

2. A coolable lining according to claim 1, characterized by the fact that each of the cooling elements include an outer tube having a closed bottom end and an open top end, and an inner tube concentrically disposed within the outer tube for the introduction and removal of the cooling medium, each of the cooling elements further including connectors extending from the open outer end for introduction and removal of the cooling medium.

3. A coolable lining according to claim 1, characterized by the fact that the channels in the refractory brickwork have a larger interior diameter than the exterior diameter of the cooling elements, and that the interstitial space between the refractory brickwork and each cooling element is filled with a mechanically resilient heat-transfer medium.

4. A coolable lining according to claim 3, characterized by the fact that the heat-transfer medium is felted metal wire.

5. A coolable lining according to claim 1, characterized by the fact that adjacent channels are axially offset from one another.

6. A coolable lining according to claim 5, characterized by the fact that the arrangement of a respective polygon is formed by blind holes of equal height in the refractory brickwork.

7. A coolable lining according to claim 1, characterized by the fact that a sensor is associated with one of the cooling elements for monitoring temperature changes and leakages in the one cooling element.

8. A coolable lining according to claim 7, characterized by the fact that a sensor is associated with each one of the cooling elements for monitoring temperature changes and leakages in the respective cooling element.

9. A coolable lining according to claim 1, characterized by the fact that heat-conductive metal strands are incorporated into the refractory brickwork of the lining, at least in the zone around the cooling channels.

* * * * *